US007858178B2

(12) United States Patent
Sander et al.

(10) Patent No.: US 7,858,178 B2
(45) Date of Patent: Dec. 28, 2010

(54) SILICATE-COATED PARTICLES IN A METAL LAYER

(75) Inventors: Jürgen Sander, Saarbrücken (DE); Wolfgang Ludt, Hanweiler (DE)

(73) Assignee: Nanogate AG, Saarbruecken (DE)

( * ) Notice: Subject to any disclaimer, the term of this patent is extended or adjusted under 35 U.S.C. 154(b) by 48 days.

(21) Appl. No.: 12/094,810

(22) PCT Filed: Nov. 13, 2006

(86) PCT No.: PCT/EP2006/068369

§ 371 (c)(1),
(2), (4) Date: Jun. 11, 2008

(87) PCT Pub. No.: WO2007/062974

PCT Pub. Date: Jun. 7, 2007

(65) Prior Publication Data

US 2008/0254280 A1 Oct. 16, 2008

(30) Foreign Application Priority Data

Nov. 30, 2005 (DE) ..... 10 2005 057 384

(51) Int. Cl.
*C25D 7/00* (2006.01)
*B32B 5/16* (2006.01)

(52) U.S. Cl. ..... 428/331; 428/701; 428/391; 428/405; 428/446; 428/447

(58) Field of Classification Search ..... None
See application file for complete search history.

(56) References Cited

U.S. PATENT DOCUMENTS

| | | | | |
|---|---|---|---|---|
| 4,479,855 | A | 10/1984 | Thoma et al. | |
| 5,145,517 | A | 9/1992 | Feldstein et al. | |
| 5,588,477 | A * | 12/1996 | Sokol et al. | 164/34 |
| 5,642,632 | A | 7/1997 | Nanya et al. | |
| 6,319,108 | B1 * | 11/2001 | Adefris et al. | 451/533 |
| 6,440,322 | B1 * | 8/2002 | Kim et al. | 252/62.52 |
| 6,634,929 | B1 * | 10/2003 | Visser | 451/41 |
| 2004/0121073 | A1 * | 6/2004 | George et al. | 427/215 |

FOREIGN PATENT DOCUMENTS

| | | | |
|---|---|---|---|
| DE | 10301135 | A1 | 7/2004 |
| EP | 0492223 | A2 | 7/1992 |
| EP | 0595471 | A2 | 5/1994 |

* cited by examiner

*Primary Examiner*—Jennifer C McNeil
*Assistant Examiner*—Vera Katz
(74) *Attorney, Agent, or Firm*—Harness, Dickey & Pierce, PLC

(57) ABSTRACT

The invention relates to an electrodeposited metal layer on a substrate with embedded particles, especially inorganic particles, which have a silicate coating, and to the use of such layer for coating machine parts.

19 Claims, No Drawings

SILICATE-COATED PARTICLES IN A METAL LAYER

FIELD

The present disclosure relates to an electrodeposited metal layer on a substrate with embedded particles, wherein said embedded particles have an $SiO_2$ (silicate) coating.

BACKGROUND

Electrodeposited metal layers with embedded particles are known. For example, hard material particles are embedded in electrodeposited nickel layers as a wear protection.

Thus, from DE 3503859 A1, it is known to embed boron nitride particles and silicon carbide particles directly in an electrodeposited nickel layer.

DE 10301135 A1 also describes the embedding of hard material particles in an electrodeposited nickel layer.

U.S. Pat. No. 4,479,855 A describes the embedding of silicon carbide particles in electrodeposited nickel. In this method, a complicated dispersing agent system is employed since hard material particles alone do not form a stable dispersion, and a uniform distribution of the particles in the resulting nickel layer can be achieved only by the dispersing agent system.

Due to the surface potential of hard materials, they are hardly or not at all dispersible in water and thus it has been necessary to date to keep them in dispersion with complicated dispersing agent systems.

Quite independently thereof, the coating of particles with silicates has also been known. For example, EP 0 492 223 A2 may be mentioned, which relates to silanized pigments and the use thereof for the inhibition of the yellowing of pigmented plastic materials, wherein the increase of the stability of pigment surfaces towards the action of air, oxygen, heat and light is addressed, and a chemisorption of silane compounds to pigments is mentioned, wherein said pigment coating is to be effected, in particular, with addition of solvents or other materials, such as coupling agents or carrier liquids, in an intensive mixer. Further, DE 19817286 may be mentioned, which relates to a multilayered pearlescent pigment based on an opaque substrate, this application discussing among others the pigmentation of bonds and security papers and packages as well as the laser labeling of polymeric materials and papers. In this document, it is proposed to coat gamma pigments having a particle size of from about 10 μm to cause them to show a particularly pronounced color flop, which means that the interference colors of the gamma are to depend very strongly on the viewing angle.

EP 0245984 A1 describes the coating of titanium dioxide particles with silicate. The addition of the silicate solution during the coating takes place without additional energy input at a pH that is substantially above the isoelectric point of titanium dioxide.

U.S. Pat. No. 6,440,322 B1 describes the coating of iron oxide particles with silicate.

DE 69708085 T2 describes the coating of oxide particles with silicon dioxide.

SUMMARY

Thus, it is the object of the present invention to be able to embed particles uniformly in electrodeposited metals without having to use a complicated dispersing agent system that takes the adverse surface potential of the particles into account.

DETAILED DESCRIPTION

In a first embodiment, the object of the invention is achieved by an electrodeposited metal layer on a substrate with embedded particles, especially inorganic particles, characterized in that said particles, especially inorganic particles, have an $SiO_2$ (silicate) coating.

Thus, in particular, the metal layer according to the invention contains inorganic particles with a silicate coating, whereby the zeta potential of the primary particles can be easily adjusted, which results in an improved dispersing behavior and a unitary behavior in an electric field.

Due to the silicate coating of the particles, particles that are otherwise difficult to disperse, for example, those being redox-active in water, could be homogeneously distributed in an electrodeposited metal layer without a concentration gradient. The particles with a silicate coating are readily dispersed in water. This is particularly important for particles such as zirconium oxide, zirconyl sulfate, tungsten carbide, titanium nitride, titanium boride, titanium carbide, titanium dioxide, aluminum oxide (corundum), boron carbide ($B_4C$), graphite, diamond, boron nitride (hexagonal BN), silicon nitride or molybdenum sulfide, which are very hardly or not at all dispersible in aqueous systems.

For example, this also applies to carbon nanotubes, whose processing has been possible to date only with high difficulty and only in low concentrations and in a limited number of solvents, which has strongly limited their application in the industry previously. In the coating according to the invention, such materials can also be embedded in electrodeposited metal layers due to their being readily dispersible in the electrolytic bath.

Advantageously, the inorganic particles are contained in the metallic layer in an amount of from 20 to 80% by weight, especially from 30 to 50% by weight. Due to the poor dispersibility, particle contents as low as up to 20% by weight could be achieved in known methods. Due to the silicate coating, these preferred particle contents can now be achieved. These are particularly advantageous because the electrodeposited metal layers can thus be provided with substantially higher scratch resistance or sliding property.

The particles advantageously comprise a hard material, especially a material having a Vickers hardness of at least 20 GPa. In such a high concentration, these particles, which were hardly dispersible previously, can provide for an unprecedented scratch resistance in the electrodeposited metal layer.

Preferably, the particles have a diameter within a range of from 0.01 to 40 μm, especially within a range of from 0.1 to 10 μm. If the particle size is too high, an undesirable roughness in the surface may result. If the diameter is too small, increased numbers of the particles are in a quasi amorphous state. The particular properties, such as particular sliding property and particular hardness, which is mainly related to the crystal structure and crystal planes, then cannot be transferred to the surface of the coated metal layer.

The metallic layer is preferably a nickel layer, because it is just nickel layers that benefit to a particular extent from an increased sliding property or, in particular, an increased scratch resistance. Alternatively, chromium layers, copper layers or mixed metal layers, such as brass or bronze, can be deposited in a similar way.

The coating of silicon dioxide on the embedded inorganic particles preferably has a thickness within a range of from 2 to 800 nm, especially from 10 to 300 nm. If the thickness is too low, the properties of the particles provided with the silicate coating are not sufficiently manifested. However, if the layer thickness is too high, the zeta potential of the particles may again approximate the zeta potential of the originally uncoated particles and thus inhibit dispersion.

Advantageously, the concentration of the particles in the metallic layer does not have a gradient. Accordingly, the distribution is very homogeneous. Thus, during use, when the outermost exposed metallic layer has worn, the property such as scratch resistance of sliding property can still be kept constant.

In another embodiment, the object of the invention is achieved by the use of the particle-containing metallic layer for the coating of machine parts, especially parts for engines.

Example 4.68 g of graphite (D90: about 1 μm) coated with a 40 nm thick silicate coating was admixed with 1.73 ml of FC 135 (fluorosurfactant supplied by 3M) and 16 ml of water. After 1 hour, a mixture of 0.9 g of emulsifier OP 25 (BAST) and 0.69 g of FC 135 was added. The mixture obtained was added to a chemical nickel electrolyte bath (1.8 l, Nichem PF500-BG, Atotech Deutschland GmbH). It was heated at 85° C., whereupon deposition began. After one hour, the experiment was finished.

Result: A nickel layer with metallic gloss was obtained.

What is claimed is:

1. A composite comprising a metal layer electrodeposited on a substrate, wherein the metal layer comprises inorganic particles embedded in the metal layer, wherein the particles are selected from zirconium oxide, zirconyl sulfate, tungsten carbide, titanium nitride, titanium boride, titanium carbide, titanium dioxide, aluminum oxide, boron carbide, graphite, boron nitride, silicon nitride, and molybdenum sulfide, and have an $SiO_2$ coating.

2. The composite according to claim 1, wherein the particles are contained in the layer in an amount of from 20 to 80% by weight.

3. The composite according to claim 1, wherein the particles comprise a material having a Vickers hardness of at least 20 GPa.

4. The composite according to claim 1, wherein the particles have a diameter within a range of from 0.01 to 40 μm.

5. The composite according to claim 1, wherein the layer is a nickel layer.

6. The composite according to claim 1, wherein the coating of $SiO_2$ has a thickness within a range of from 10 to 100 nm.

7. The composite according to claim 1, wherein the concentration of the particles in the layer does not have a gradient.

8. The composite according to claim 1 wherein the substrate is a machine part.

9. The composite according to claim 1, wherein the particles have a diameter within a range of from 0.1 to 10 μm.

10. The composite according to claim 1, wherein the coating of $SiO_2$ has a thickness within a range of from 50 to 90 nm.

11. A composite comprising an electrodeposited metal layer applied to a substrate, the metal layer comprising a nickel alloy and comprising $SiO_2$ coated inorganic particles embedded therein, wherein the inorganic particles are selected from zirconium oxide, zirconyl sulfate, tungsten carbide, titanium nitride, titanium boride, titanium carbide, titanium dioxide, aluminum oxide, boron carbide, graphite, boron nitride, silicon nitride, and molybdenum sulfide.

12. The composite according to claim 11, wherein the particles are contained in the layer in an amount of from 20 to 80% by weight.

13. The composite according to claim 11, wherein the particles comprise a material having a Vickers hardness of at least 20 GPa.

14. The composite according to claim 11, wherein the particles have a diameter within a range of from 0.01 to 40 μm.

15. The composite according to claim 11, wherein the particles have a coating of $SiO_2$ having a thickness within a range of from 10 to 100 nm.

16. The composite according to claim 11, wherein the concentration of the particles in the layer does not have a gradient.

17. The composite according to claim 11 wherein the substrate is a machine part.

18. A composite comprising a substrate and a metal layer electrodeposited on the substrate, wherein the metal layer further comprises embedded particles, and wherein:

the particles comprise an inorganic particle coated by $SiO_2$, the metal layer comprises 20-80% by weight of the coated particles, and the concentration of the particles in the metal layer does not have a gradient, wherein the inorganic particle is selected from zirconium oxide, zirconyl sulfate, tungsten carbide, titanium nitride, titanium boride, titanium carbide, titanium dioxide, aluminum oxide, boron carbide, graphite, boron nitride, silicon nitride, and molybdenum sulfide.

19. A composite according to claim 18, wherein the metal layer comprises nickel.

* * * * *